US005707224A

United States Patent [19]

Yang

[11] Patent Number: 5,707,224

[45] Date of Patent: Jan. 13, 1998

[54] LIQUID PUMP HAVING AN ELONGATE SLIDER AND A PAIR OF ROTATING DISKS

[76] Inventor: Gene-Huang Yang, P.O. Box 55-175, Taichung, Taiwan

[21] Appl. No.: 727,270

[22] Filed: Oct. 8, 1996

[30] Foreign Application Priority Data

Jul. 30, 1996 [TW] Taiwan ..... 85211653

[51] Int. Cl.[6] ..... F04C 2/00

[52] U.S. Cl. ..... 418/240; 418/247

[58] Field of Search ..... 418/240, 244, 418/245, 247

[56] References Cited

U.S. PATENT DOCUMENTS 619,434 2/1899 Phifer ..... 418/245

4,451,214 5/1984 Kagamiyama ..... 418/247

5,350,287 9/1994 Secord ..... 418/245

*Primary Examiner*—John J. Vrablik

[57] ABSTRACT

A liquid pump comprises generally a base, an annular ring including a pair of ingresses and a pair of egresses alternately formed on opposing circumferential walls aside a pair of rectangular recesses therebetween and defining a fluid channel between the base and itself, first and second swivel disks including a rotary plunger and a pushing rod on their under sides and rotating inversely inside the pump. An elongate slider sliding to and fro in a rectangular groove coactes with the rotary plunger for repeatedly changing the vacuum circumstances in the channel to synchronously suck and discharge the liquid material from one container to another.

6 Claims, 4 Drawing Sheets

LIQUID PUMP HAVING AN ELONGATE SLIDER AND A PAIR OF ROTATING DISKS

BACKGROUND OF THE INVENTION

The present invention relates to liquid transferring devices and more particularly to a liquid pump which adapts a rotary plunger and an elongate slider sliding about a fluid channel in the pump and coacted to repeatedly change spatial state in order to suck and synchronously discharge the liquid material from one container to another.

Typical liquid transferring devices includes generally a gear pump, a vane pump or a plunger pump, wherein the gear pump utilizes the negative pressure created from a transient disengagement of the gears to suck the liquid material from a container into the pump and to discharge the liquid material from the pump synchronously under a compressive force when the gears are engaged. This pump has an advantage to work under low pressure and/or low fluid speed, but can not work under high pressure and/or high fluid speed. Besides, it is expensive to manufacture. The most important components for the vane pump are the rotor and the vane which are difficult to manufacture. It also has a disadvantage in that the liquid fluid is easy to degrade during the liquid transference; The plunger pump has an advantage to work under high pressure. However, it causes a great vibration and makes noise and especially has a high abrasion ratio because of the lateral component of force.

SUMMARY OF THE PRESENT INVENTION

The present invention has a main object to provide a liquid pump which has a novel structure and liquid transferring process so as to obtain a high effectiveness, minimum vibration and noise and low cost to manufacture.

Another object of the present invention is to provide a liquid pump which adapts a rotary plunger constantly sliding about an annular fluid channel concentrical with the central axis of the pump.

Still another object of the present invention is to provide a liquid pump which adapts an elongate slider slidably disposed along a radial groove in the pump and across the opposite circumference of the fluid channel.

Further object of the present invention is to provide a liquid pump which adapts a plurality of check valves on opposite sides of the pump for controlling the fluid direction of the liquid material.

Still further object of the present invention is to provide a liquid pump in which the coaction of the rotary plunger and the elongate slider can repeatedly change the spatial state in the channel for synchronously sucking and discharging the liquid material from one container to another.

The present invention will become more fully understood by reference to the following detailed description thereof when read in conjunction with the attached drawings.

DETAILED DESCRIPTION OF THE PREFERRED EMBODIMENT

Figure 1:
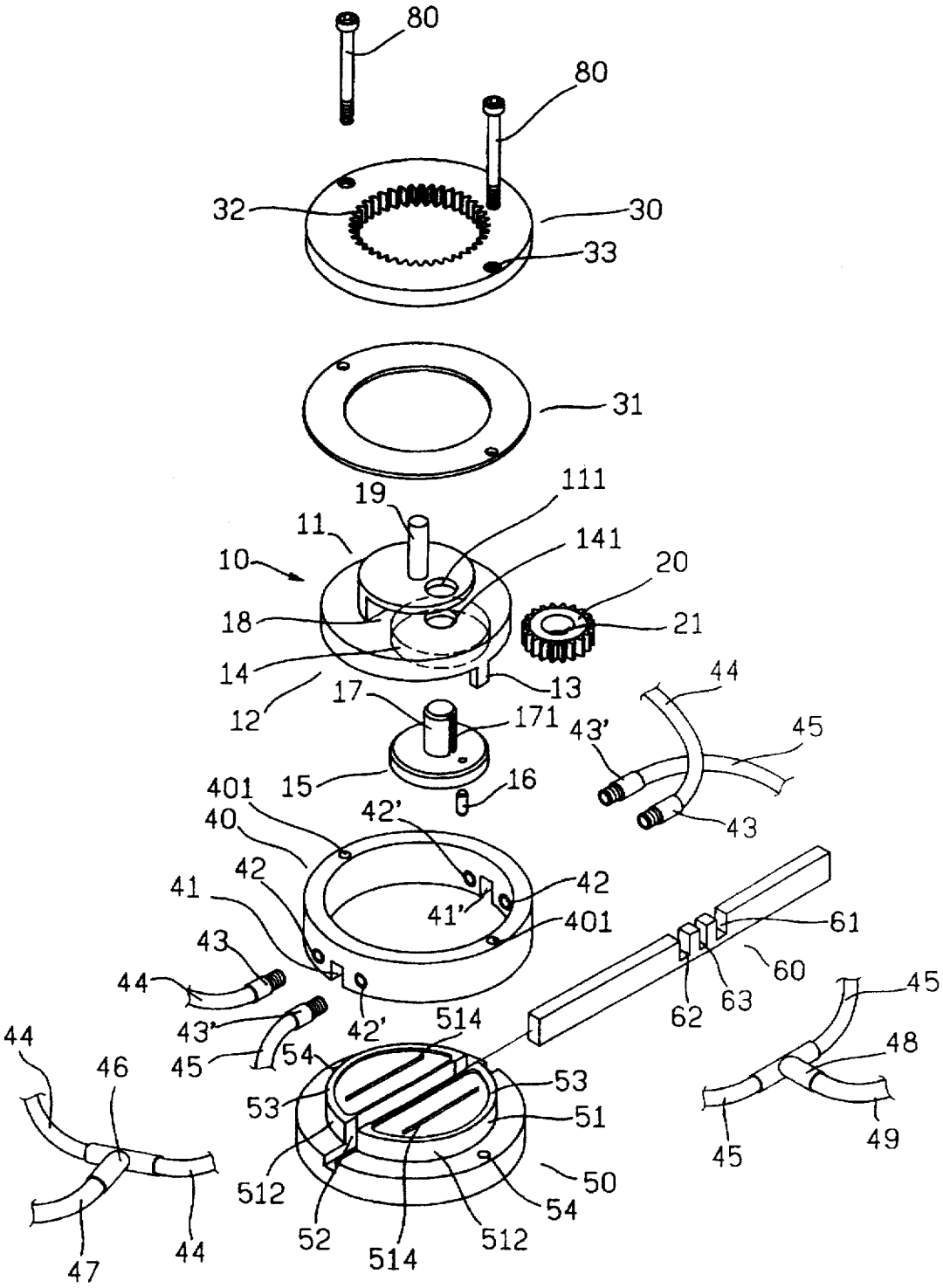
FIG. 1 is an exploded perspective view to show a preferred embodiment of the present invention.
Figure 2:
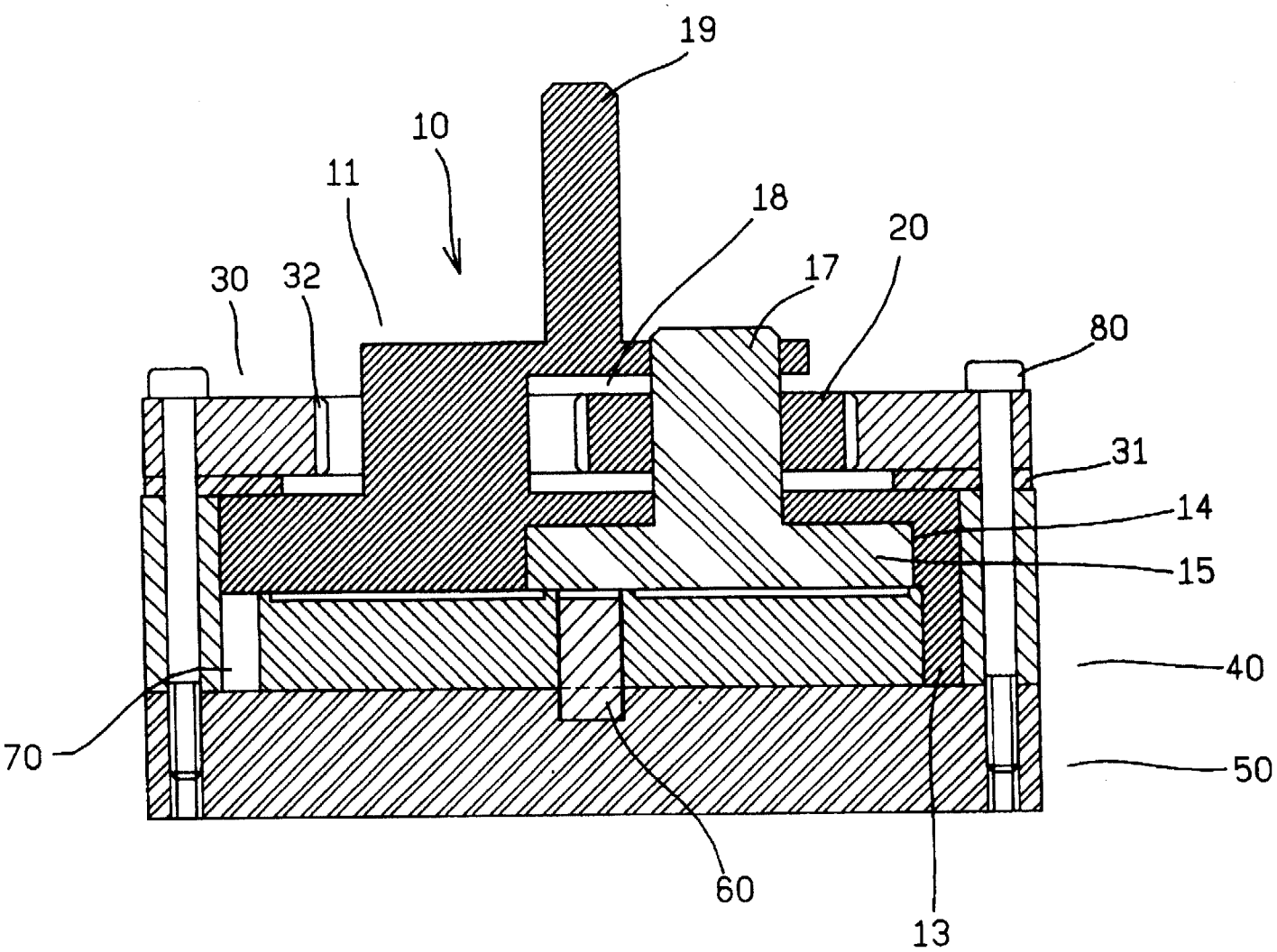
FIG. 2 is a sectional view of an assembled liquid pump of FIG. 1, and FIGS. 3, 4, 5 and 6 are the diagrams to indicate the operational state of the liquid pump according to the present invention.

Referring to FIGS. 1 and 2 of the drawings, the liquid pump of the present invention comprises generally a base

50, an annular ring 40, a serrated annular ring 30, an annular gear 20, a swivel disk 10 and an elongate slider 60, wherein:

The base 50, which may be in another configuration to coincide with the elongate slider 60, has a lesser diameter circular protrusion 51 centrally projected upward from a planar surface and divided into two identical semi-circular sections 512 by an elongate rectangular groove 52 which is formed along a radial line and across the body of the base 50. The semi-circular sections 512 each have a flange 53 projected upward from the circumferential edge and an elongate projection 514 centrally extended on the top and parallel to the groove 52. The base 50 further has a plurality of threaded screw holes 54 vertically formed in the opposite circumferences.

The elongate slider 60 has a elongate rectangular body longer than the outer diameter of the base 50 and a dimension equal to that of the rectangular groove 52 so as to be slidable in the groove 52, three slots medially form spaced apart in the upward surface in the manner such that the first slot 63 is positioned at the middle between the second and third slots 61 and 62.

The annular ring 40 has a pair of first and second rectangular recesses 41 and 41' symmetrically formed in the under side of the opposite circumferential walls. The recesses 41 and 41' are made in registry with the end portions of the rectangular groove 52 and dimensionally equal to that of the elongate slider 60 which enables the elongate slider 60 to be slidable thereabout. A pair of ingresses 42 and a pair of egresses 42' are alternately formed on the lateral sides of the first and second rectangular recesses 41 and 41' for respectively engaging with a pair of ingress check valves 43 and a pair of egress check valves 43' which connect respectively with a pair of ingress pipes 44 and a pair of egress pipes 45 in the manner such that the pair of ingress pipes 44 respectively connect to the pair of ingress check valves 43 on opposite circumferential walls of the annular ring 40 and then join with a first T-pipe 46 which further connects to a supply pipe 47, where the pair of egress pipes 45 respectively connect to the pair of egress check valves 43' and then join with a second T-pipe 48 which further connects to a discharge pipe 49. A plurality of first vertical screw holes 401 formed through the opposite circumferential walls of the annular ring 40 made in registry with the threaded screw holes 54 of the base 50. Further, the annular ring 40 has an outer diameter equal to that of the base 50 and an inner diameter larger than the outer diameter of circular protrusion 51, so that an annular fluid channel 70 is therefore defined between the circular protrusion 51 and the annular ring 40 when it engages with the base 50.

The swivel disk 10 comprises a lower circular body 12 and a lesser diameter upper circular body 11 partially connected with the lower circular body 12 so as to define a receiving space 18 therebetween. The lower circular body 12 has an outer diameter equal to the inner diameter of the annular ring 40 and a rotary plunger 13 having a sectional size equal to that of the fluid channel 70 so that when the swivel disk 10 rotatably engages with the base 50, the lower circular body 12 will be closedly stopped against the inner periphery of the annular ring 40 and tightly coveres the top of the channel 70 to prevent the liquid material from leaking out of the channel 70. Meanwhile, the rotary plunger 13 suits to the channel 70 and movably blocks the channel 70. A circular cavity 14 is formed in the bottom of the lower circular body 12 between the rotary plunger 13 and the center of the body 12 for rotatably disposing a second swivel disk 15 therein. The cavity 14 has a central axle hole 141 through the body 12 and in alignment with the rotary plunger 13 and the center of the body 12. The second swivel disk 15 has a central axis 17 projected upward and inserted through the axle hole 141 and then rotatably anchored into a second axle hole 111 adjacent a circumference of the upper circular body 11. The central axis 17 has a vertical slot 171 in a peripheral wall for engaging with a vertical projection 21 on a inner peripheral wall of the annular gear 20 when it mounts on between the upper and lower circular bodies 11 and 12 and rotated in concert with the second swivel disk 15. A pushing rod 16 pivotally secured to the bottom of the second swivel disk 15 adjacent a circumference where has an elongated axle line perpendicular to the pitch circle of the gear 20. When assembled, the pushing rod 16 is stopped into the first slot 63 of the elongate slider 60. The upper circular body 11 further has a central shaft 19 projected upward from the top for engaging with an external driven source (not shown).

The serrated annular ring 30 axially connects to the top of the annular ring 40 by means of bolts 80 with a bushing ring 31 stiffened therebetween and has a plurality of teeth around the inner peripheral wall engageable with the teeth of the gear 20 and a plurality of third vertical screw holes 33 made in registry with the first vertical screw holes 401 of the annular ring 40, so that the bolts 80 are enabled to be sequentially inserted through the serrated annular ring 40, the bushing ring 31 and the annular ring 40 and then fastened in the threaded screw holes 54 of the base 50. Note that the bushing ring 31 has a plurality of third vertical screw holes in the circumference and an inner diameter smaller than the outer diameter of the lower circular body 12 of the swivel disk 10 and larger than the inner diameter of the inner periphery of the serrated annular ring 30 so that the swivel disk 10 will be protected by the bushing ring 31 from getting rid of the pump without preventing the engagement of the teeth between the serrated annular ring 30 and the gear 20. Furthermore, the pitch diameter of the serrated annular ring 30 is twofold per the pitch diameter of the gear 20, so that when the swivel disk 10 rotates clockwise for one circle within the annular ring 40, the gear 20 shall rotate counterclockwise for two circles within the swivel disk 10. Because of the counter rotation of the swivel disk 10 and the gear 20, the locus of the pushing rod 16 is no longer a curve but moves to and fro along a straight line parallel to the rectangular groove 52 of the base 50. This arrangement enables the elongate slider 60 to be actuated by the pushing rod 16 to straightly slide about the groove 52. FIG. 2 shows an assembled liquid pump of the present invention.

Figure 4:
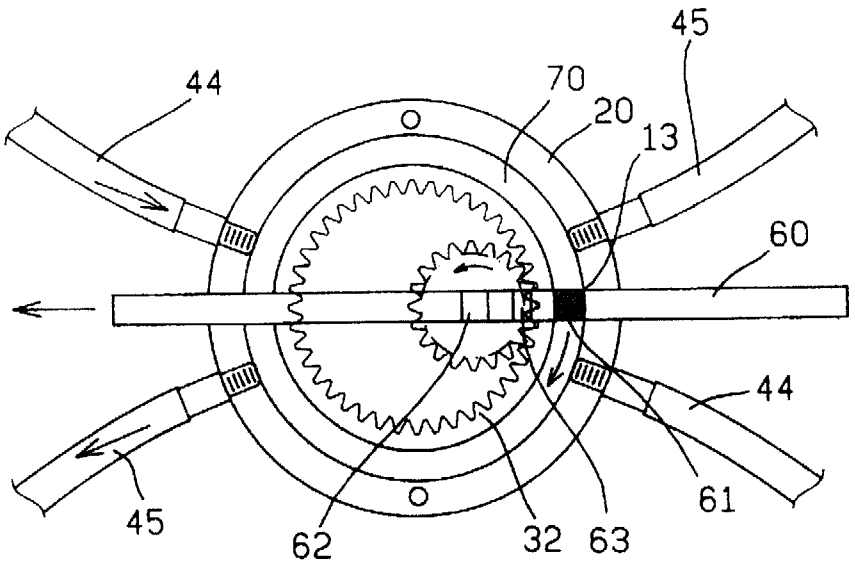
Figure 3:
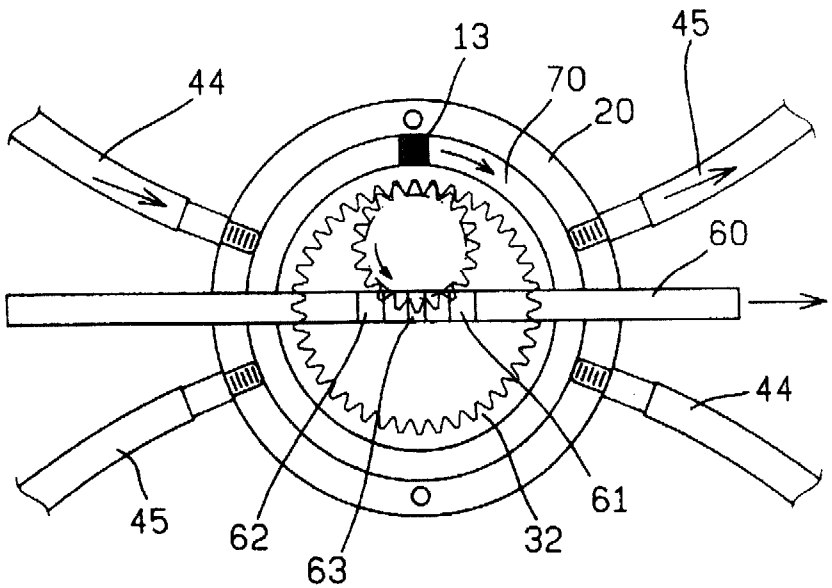
Figure 6:
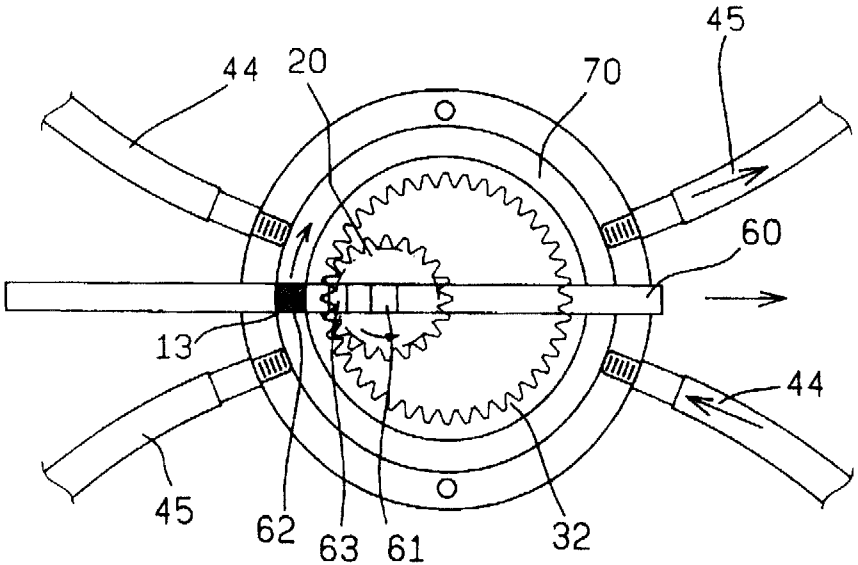
Figure 5:
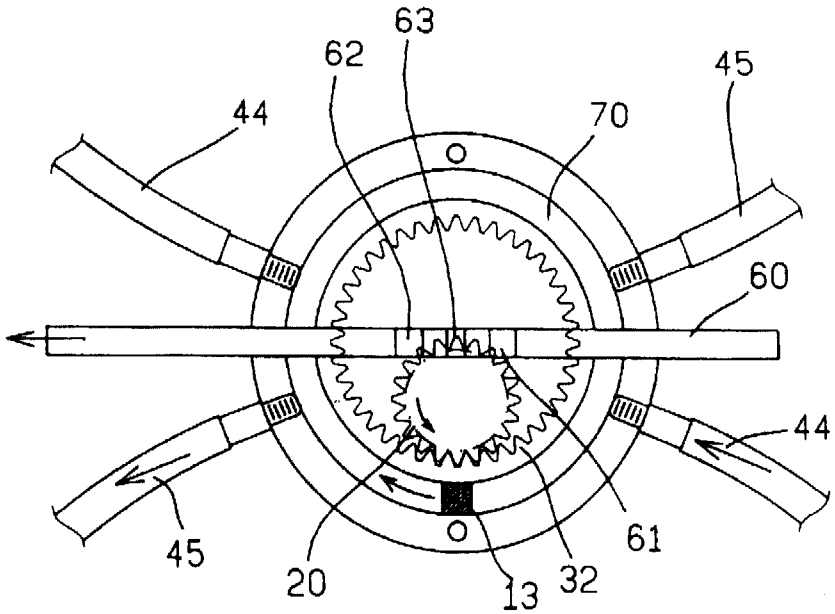

Referring to FIGS. 3, 4, 5 and 6 of the drawings, the operation of the liquid pump of the present invention is shown. When the swivel disk 10 is driven to rotate clockwise in the pump and drives the rotary plunger 13 moving forward in the liquid channel 70, the gear 20 cog engaged with serrated annular ring 30 must rotate counterclockwise to drive the pushing rod 16 to actuate the elongate slider 60 sliding about groove 52. FIG. 3 shows the rotary plunger 13 at a middle of the upper half channel beginning to move forward, and the first slot 63 of the elongate slider 60 at the center of the pump is pushed to move towards right side. Since the channel 70 is blocked up by the elongate slider 60, an arcuate vacuum is established between the slider 60 and the rotary plunger 13 that begins to suck liquid material from the supply pipe 44 and releases it through the discharging pipe 45. When the rotary plunger 13 reaches the recess 41', the second slot 61 of the slider 60 reaches the channel 70 and aligns with the channel 70 so as to permit the plunger 13 passing through to move continuously in the lower half of the channel 70 (as shown in FIG. 4). FIG. 5 shows that the elongate slider 60 is returned to a normal position and blocks the liquid channel 70 again so as to establish another arcuate vacuum in the lower half channel 70 and the liquid material from another supply pipe 44 is sucked into the vacuum while the liquid material remained in the forward side of the plunger 13 is pressed to release out of the pump through another discharging pipe 45. When the plunger 13 reaches to the recess 41, the third slot 62 of the elongate slider 60 meets the channel 70 and enables the rotary plunger 13 passing through to enter into the upper half channel 70 again (as shown in FIG. 6). Upon the above repeated sucking and discharging movement within the liquid channel 70, the liquid pump of the present invention will continuously and effectively transfer the liquid material from one container to another.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A device for transferring liquid material from one container to another comprising:

a base having a lesser diameter circular protrusion centrally projected upward from a planar surface thereof and divided into a pair of identical semi-circular sections by an elongate rectangular groove along a radial line of said base, said semi-circular sections each including a circumferential flange projected upward from a top thereof and an elongate projection centrally extended on the top and parallel to said rectangular groove, and a plurality of threaded screw holes vertically formed in opposite circumferences respectively;

an elongate slider slidably disposed into said rectangular groove of said base, said slider being longer than said rectangular groove and having a first slot formed in a top of a middle of said slider and a pair of second and third slots respectively formed adjacent two lateral sides of said first slot at their predetermined positions;

an annular ring axially coupled with said base to define a fluid channel between itself and said lesser diameter circular protrusion, said annular ring having an outer diameter equal to that of said base, an inner diameter larger than the outer diameter of said circular protrusion, a plirality of first vertical screw holes formed in opposite circumferential walls in registry with the threaded screw holes of said base, a pair of first and second rectangular recesses symmetrically formed in an under side of opposite circumferential walls in registry with respective ends of said rectangular groove and the dimension of said elongate slider, an ingress at one side of said first and second rectangular recesses and an egress at another side of said recesses for respectively engaging with a pair of ingress check valves and a pair of egress check valves which further connect to a plurality of supply and discharging pipes;

a first swivel disk axially and rotatably coupled with said lesser diameter circular protrusion and engaged with an inner periphery of said annular ring, said first swivel disk having a lower circular body which includes a rotary plunger extended downward from adjacent a circumference for engaging into said fluid channel and a lesser diameter cavity formed in an under side between said rotary plunger and the center of said disk including a central axle hole through said body, a lesser diameter upper circular body centrally extended upward from a top of said lower circular body and partially connected with said lower circular body for defining a receiving space therebetween, said upper circular body further comprising a central axis projected upward from a top for connecting with an external driven source and an axle hole adjacent an circumference made in registry with the central axle hole of said lesser diameter cavity;

a second swivel disk rotatably disposed into said lesser diameter cavity of said first swivel disk, said second swivel disk having a pushing rod pivotally secured to an under side adjacent a circumference thereof and engaged into the first slot of said elongate slider and a central axis projected upward from a top and inserted through the central axle hole of said lesser diameter cavity and then pivotally anchored into the axle hole of said upper circular body of said first swivel disk, said central axis including a vertical slot in a peripheral wall thereof;

a gear secured on the central axis of said second swivel disk and the reciveing space between said upper and lower circular body of said first swivel disk for rotating in concert with said second swivel disk, said gear having teeth around an outer periphery and a vertical projection on an inner periphery made in registry with the vertical slot of said central axis;

a bushing ring engaged on the top of said annular ring, said bushing ring having a plurality of second vertical screw holes adjacent opposing circumferences made in registry with the first vertical screw holes of said annular ring and an inner diameter smaller than the outer diameter of said first swivel disk for protecting said disk from getting rid of said pump;

a serrated annular ring axially disposed on said bushing ring, said ring having a plurality of inward teeth around an inner periphery and cog-engaged with said gear and a plurality of third vertical screw holes adjacent opposing circumferences made in registry with the second vertical screw holes of said bushing ring;

means for fastening said pump sequentially inserted into the third, second and first vertical screw hole of said rings and fastened into the threaded screw holes of said base;

whereby, said pump utilizes said rotary plunger in coaction with said elongate slider to repeatedly change the vacuum circumstances in said fluid channel to synchronously suck and discharge the liquid material from one container to another.

2. A device as recited in claim 1 wherein said rotary plunger has a size equal to the sectional dimension of said liquid channel and slides in said channel.

3. A device as recited in claim 1 wherein said serrated annular ring has a pitch diameter of twofold per the pitch diameter of said gear.

4. A device as recited in claim 1 wherein said first swivel disk rotates clockwise and said second swivel disk rotates counterclockwise.

5. A device as recited in claim 1 wherein said pushing rod has an axle line perpendicular to the pitch circle of said gear and moves said elongate slider sliding to and fro along a straight line parallel to said rectangular groove.

6. A device as recited in claim 1 wherein said plurality of supply and discharging pipes further connect to a T-pipe respectively.

* * * * *